US009091432B2

(12) United States Patent
Yang

(10) Patent No.: US 9,091,432 B2
(45) Date of Patent: Jul. 28, 2015

(54) BIOMASS FUEL INTERNAL CIRCULATION MECHANICAL FLUIDIZED-BED CORNER TUBE INTELLIGENT BOILER

(76) Inventor: Zhijun Yang, Qingdao (CN)

( * ) Notice: Subject to any disclaimer, the term of this patent is extended or adjusted under 35 U.S.C. 154(b) by 788 days.

(21) Appl. No.: 13/394,151

(22) PCT Filed: May 24, 2011

(86) PCT No.: PCT/CN2011/000889

§ 371 (c)(1),
(2), (4) Date: Mar. 4, 2012

(87) PCT Pub. No.: WO2012/031448

PCT Pub. Date: Mar. 15, 2012

(65) Prior Publication Data

US 2012/0272874 A1 Nov. 1, 2012

(30) Foreign Application Priority Data

Sep. 8, 2010 (CN) ..... 2010 1 0275701

(51) Int. Cl.

| | |
|---|---|
| ***F23G 5/00*** | (2006.01) |
| ***F23C 10/00*** | (2006.01) |
| ***F23C 6/04*** | (2006.01) |
| ***F23C 10/12*** | (2006.01) |
| ***F23C 10/20*** | (2006.01) |

(52) U.S. Cl.

CPC ..... *F23C 10/007* (2013.01); *F23C 6/04* (2013.01); *F23C 10/12* (2013.01); *F23C 10/20* (2013.01)

(58) Field of Classification Search

CPC ..... F23C 6/04; F23C 10/20; F23C 10/12; F23C 10/007; F23C 6/02; F23C 2206/103; F23C 10/005; F23C 3/008; F23G 5/027; F23G 5/16; F23G 7/00; C10J 3/18; C10J 3/54; F22B 31/0084; F01K 23/067

USPC ..... 110/245, 208–210, 295, 346–348; 122/4 D, 406.1, 488; 432/58, 170; 422/141

See application file for complete search history.

(56) References Cited

U.S. PATENT DOCUMENTS

| | | | | | |
|---|---|---|---|---|---|
| 2,869,519 | A | * | 1/1959 | Schroedter et al. | 122/478 |
| 2,911,284 | A | * | 11/1959 | Hochmuth | 423/531 |
| 3,785,304 | A | * | 1/1974 | Stookey | 110/346 |
| 3,916,619 | A | * | 11/1975 | Masai et al. | 60/756 |
| 4,031,860 | A | * | 6/1977 | Recht | 122/240.3 |
| 4,060,041 | A | * | 11/1977 | Sowards | 110/245 |

(Continued)

*Primary Examiner* — Kenneth Rinehart
*Assistant Examiner* — Bao D Nguyen

(57) ABSTRACT

The present invention discloses a biomass fuel internal circulation mechanical fluidized-bed corner tube intelligent boiler which is highly effective in energy-conservation and emission-reduction, which comprises a primary combustion chamber, a secondary combustion chamber, a burning-out chamber, a high temperature multi-tube cyclone dust collector, a heat convection pipe bundle, the hearth of the primary combustion chamber consists of a square membrane water-cooled wall and a profiled seat with a square top and a circular bottom, at the four corners of the seat, there are mounted Venturi tube internal circulators, at the bottom of the hearth, there is mounted a mechanical fluidizing machine; the profiled cyclone separation hearth of the secondary combustion chamber consists of a square membrane water-cooled wall, a profiled seat with a square top and a circular bottom, a profiled fume-venting tube, at the bottom of the hearth, there is mounted a mechanical fluidizing machine.

4 Claims, 7 Drawing Sheets

(56) References Cited

U.S. PATENT DOCUMENTS

| | | | | | |
|---|---|---|---|---|---|
| 4,253,425 | A | * | 3/1981 | Gamble et al. | 122/4 D |
| 4,285,328 | A | * | 8/1981 | Fritz et al. | 126/225 |
| 4,301,771 | A | * | 11/1981 | Jukkola et al. | 122/4 D |
| 4,400,150 | A | * | 8/1983 | Smith et al. | 431/170 |
| 4,442,796 | A | * | 4/1984 | Strohmeyer, Jr. | 122/4 D |
| 4,517,903 | A | * | 5/1985 | Richmond et al. | 110/233 |
| 4,627,365 | A | * | 12/1986 | Tseng | 110/240 |
| 4,724,776 | A | * | 2/1988 | Foresto | 110/235 |
| 4,823,712 | A | * | 4/1989 | Wormer | 110/245 |
| 5,176,089 | A | * | 1/1993 | Jonsson | 110/245 |
| 5,181,481 | A | * | 1/1993 | Dietz | 122/4 D |
| 5,291,840 | A | * | 3/1994 | Nakao | 110/235 |
| 5,299,532 | A | * | 4/1994 | Dietz | 122/4 D |
| 6,852,293 | B1 | * | 2/2005 | Ronchi | 422/198 |
| 2010/0288171 | A1 | * | 11/2010 | Broglio et al. | 110/185 |

* cited by examiner

BIOMASS FUEL INTERNAL CIRCULATION MECHANICAL FLUIDIZED-BED CORNER TUBE INTELLIGENT BOILER

FIELD OF THE INVENTION

The present invention relates to the technical field of the renewable energy resources conversion, and in particular to a biomass fuel boiler.

BACKGROUND OF THE INVENTION

Biomass energy resources application technology has undergone a rapid development in these years under the tremendous promotion of the Chinese government. Particularly, the development of the biomass energy resource solidification direct combustion technique and its application is especially remarkable. However, at present the biomass energy resource solidification direct combustion technique and its application in China is at a low level, and there exists a relatively large gap as compared with the advanced direct combustion technique and apparatus in foreign countries. In particular, the direct combustion apparatus mainly is still used through the slight modification of the coal burning chain grate boiler. The combustion efficiency of the boiler of this kind is low, the combustion intensity is low, slag formation easily occurs, and the degree of automation is low. In particular, after the approval for installation, the customer is prone to the continuous combustion of coal under the drive of benefit, thus causing environmental pollution. However, although the circulation fluidized-bed boiler is capable of achieving a relatively good combustion result, the furnace body is too tall to achieve miniaturization, so that it is incapable of being installed in the middle or small sized coal burning boiler room to replace the middle or small sized coal burning boiler. Besides, it is incapable of satisfying the following technical demands on the boiler imposed by the large scale biomass energy resource heat supply and power generation, such as a high thermal efficiency, a small volume of boiler, a high combustion intensity, a high burning-out rate, a high degree of automation, an excellent long time running stability, and only usage of the biomass fuel.

SUMMARY OF THE INVENTION

The object of the present invention is to provide a new type biomass fuel specific boiler, which can be controlled automatically, has a high combustion intensity, has a high burning-out rate, has a high thermal efficiency, has a small total volume with a small height, can run stably for a long time, and can use only the biomass fuel.

To achieve the above object, in view of the combustion characteristics of the biomass fuel, that is, it has a high content of fugitive constituent, the high temperature pyrolysis thereof is fast, it is prone to form ash shell and the ash has a low melting point, the present invention is made by adopting the mechanical fluidization technique, the hearth folding technique, the internal circulation technique, and the high temperature pre-dedusting technique in the integral design of the boiler. The technical solution of the present invention for solving the technical problem is: a new type biomass fuel internal circulation mechanical fluidized-bed corner tube intelligent boiler, comprising a primary combustion chamber, a primary combustion chamber Venturi tube internal circulator, a primary combustion chamber mechanical fluidizing machine, a secondary combustion chamber, a secondary combustion chamber profiled separator, a secondary combustion chamber mechanical fluidizing machine, a burning-out chamber, a high temperature multi-tube cyclone dust collector, a heat convection pipe bundle. The main points thereof are as follows: the primary combustion chamber adopts a square membrane water-cooled wall and a seat with a square top and a circular bottom to constitute a profiled hearth, at the bottom of the seat, there is mounted a primary combustion chamber mechanical fluidizing machine, the primary combustion chamber mechanical fluidizing machine fluidizing fin adopts a hollow wind protection structure, on the primary combustion chamber mechanical fluidizing machine air distributing plate, there is mounted an oriented blast cap, at the four corners of the seat, there are mounted Venturi tube internal circulators. Upon combustion, the biomass fuel enters the primary combustion chamber via the feed inlet. After the biomass fuel enters the primary combustion chamber, it quickly pyrolyzes and burns under the action of the high temperature environment. Under the collective action of the mechanical fluidizing fin, the oriented blast cap and the Venturi tube nozzle, the fuel exhibits fast rotary combustion. The primary air is provide by the oriented blast cap, the wind protection fluidizing fin and the Venturi tube. The wind protection fluidizing fin is capable of quickly breaking the ash shell of the burning fuel, so as to increase the combustion rate and prevent the slag formation through the bonding of the ash shell. The large carbon granules after the pyrolysis combustion of the fuel under the action of the cyclone are thrown to the four corners of the fire wall, and are trapped by the trap hole of the Venturi tube internal circulator so as to return to the bottom of the combustion chamber and continue the combustion. The small carbon granules and the hot fume after the combustion of the primary large carbon granules are discharged into the secondary combustion chamber via the fume outlet of the primary combustion chamber.

Said secondary combustion chamber consists of the secondary combustion chamber profiled separator and the secondary combustion chamber mechanical fluidizing machine. The secondary combustion chamber profiled separator consists of the secondary combustion chamber square membrane water-cooled wall, the secondary combustion chamber profiled seat with a square top and a circular bottom, and the secondary combustion chamber profiled fume-venting tube. The secondary combustion chamber mechanical fluidizing machine is mounted at the bottom of the secondary combustion chamber. After the hot fume which enters through the fume outlet of the primary combustion chamber is separated by the secondary combustion chamber profiled separator, the small carbon granules deposit on the bottom and the fluidization combustion continues. The secondary air is provided by the mechanical fluidizing machine wind protection fluidizing fin. The mechanical fluidization on the small carbon granules by the wind protection fluidizing fin may cause the secondary air and the fuel to sufficiently mix up so as to improve the combustion intensity and effectively prevent the slag formation through the bonding of the ash shell. The hot fume after the combustion of the secondary small carbon granules and a small amount of micro-carbon granules are discharged into the burning-out chamber via the profiled fume-venting tube of the secondary combustion chamber to subject to the tertiary burning-out combustion.

Said burning-out chamber consists of a membrane water-cooled wall which is internally coated with refractory concrete. In the middle of burning-out chamber, there is mounted a refractory concrete baffle plate, which causes perturbation on the fume so as to improve the tertiary combustion rate. The high temperature multi-tube cyclone dust collector is mounted at the rear portion of the burning-out chamber. The fume inlet of the high temperature multi-tube cyclone dust collector is connected with the burning-out chamber, and the fume outlet of the high temperature multi-tube cyclone dust collector is connected with the heat convection pipe bundle. The hot fume containing fine carbon granules which enters via the secondary combustion chamber subjects to the final tertiary burning-out combustion in the burning-out chamber. The perturbation of the refractory concrete baffle plate on the fume increases the contact of air with the fuel and also increases the tertiary combustion rate. The hot fume after the tertiary burning-out combustion firstly enters the high temperature cyclone dust collector for being dedusted, exchanges heat via the heat convection pipe bundle, and then is discharged out via the fume outlet of the boiler.

The present invention adopts the mechanical fluidization, and Venturi tube internal circulation combustion style and the sectional thermal burden may reach 6 $MW/m^2$. The primary combustion chamber, the secondary combustion chamber and the burning-out chamber that are successively provided from the front to the rear in the boiler may keep the fuel in the fluidization, suspension firing condition throughout the three hearths by means of the design of the internal various structures. As a result, the height of the fluidized-bed boiler is effectively reduced, and the height of the hearth may be controlled to be about 2 meters. The pyrolysis and the primary circulation fluidization combustion of the coarse carbon granules in the primary combustion chamber, the separate secondary fluidization combustion of the fine carbon granules in the secondary combustion chamber and the tertiary suspension complete combustion in the burning-out chamber constitutes the precise sectional combustion system of the boiler, and the burning-out rate of the fuel may be up to above 99%. In particular, through the coating of the refractory concrete on the membrane water-cooled wall to adjust the amount of the heat exchange by radiation, the temperature of the primary combustion chamber may be controlled to be about 900° C., the temperature of the secondary combustion chamber may be controlled to be about 800° C., the temperature of the burning-out chamber may be controlled to be about 600° C., and the emission of NOx is effectively reduced. The high temperature multi-tube cyclone dust collector mounted at the rear portion of the burning-out chamber may remove about 90% of the ash of the fume. The pollution of the ash to the heat convection pipe bundle may be effectively reduced, so as to improve the total heat exchange efficiency of the boiler and the performance of long time stable running.

BRIEF DESCRIPTION OF THE DRAWINGS

Hereinafter, the present invention will be further explained in connection with the attached drawings.

LIST OF REFERENCE NUMERALS IN THE DRAWINGS

Figure 1:
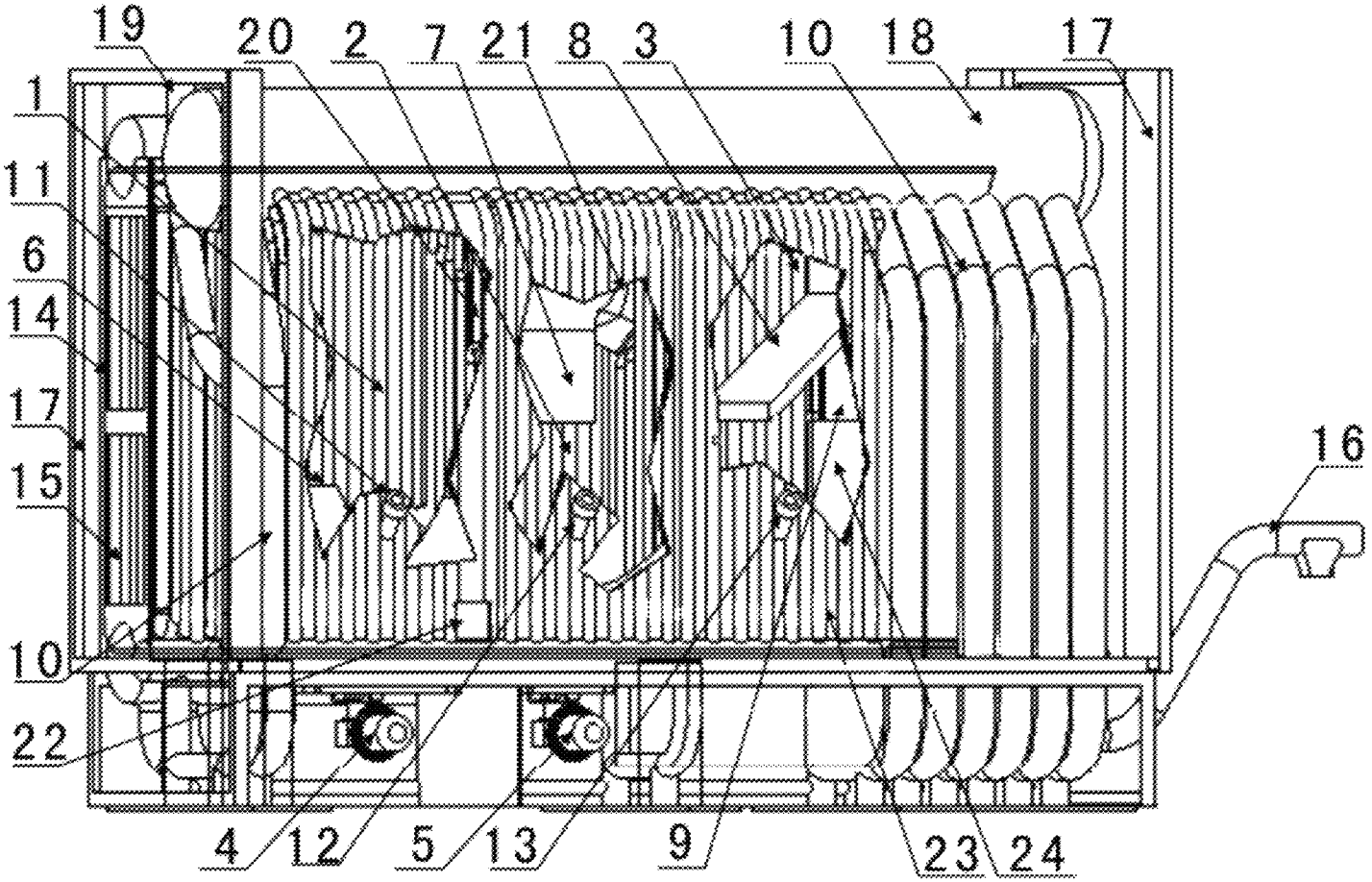
FIG. 1 is a right front view of the boiler of the present invention. In the figure, portions of the primary combustion chamber, the secondary combustion chamber and the burning-out chamber are partially cutaway. To facilitate revealing the internal structure, the front veneering plate of the boiler, the upper access door of the reversal chamber, the lower access door of the reversal chamber, the outer thermal insulation layer and the outer packaging case of the boiler are removed.

1 primary combustion chamber;
2 secondary combustion chamber;
3 burning-out chamber;
4 primary combustion chamber mechanical fluidizing machine;
5 secondary combustion chamber mechanical fluidizing machine;
6 primary combustion chamber Venturi tube internal circulator trap hole;
7 secondary combustion chamber profiled separator;
8 burning-out chamber refractory concrete baffle plate;
9 burning-out chamber fume outlet;
10 corner tube downtake;
11 primary combustion chamber observation hole;
12 secondary combustion chamber observation hole;
13 burning-out chamber observation hole;
14 heat convection pipe bundle reversal chamber upper access opening;
15 heat convection pipe bundle reversal chamber lower access opening;
16 screw-type ash removal machine;
17 boiler outer frame;
18 upper boiler drum;
19 fuel feed inlet;
20 primary combustion chamber fume outlet;
21 secondary combustion chamber profiled fume-venting tube;
22 primary combustion chamber Venturi tube internal circulator air inlet;
23 burning-out chamber membrane water-cooled wall;
24 burning-out chamber refractory concrete partition wall;
25 secondary combustion chamber mechanical fluidizing machine wind protection fluidizing fin;
26 primary combustion chamber mechanical fluidizing machine wind protection fluidizing fin;
27 primary combustion chamber Venturi tube internal circulator nozzle;
28 upper header;
29 high temperature multi-tube cyclone dust collector;
30 high temperature multi-tube cyclone dust collector fume inlet;
31 high temperature multi-tube cyclone dust collector fume outlet;
32 left header;
33 right header;
34 lower header;
35 boiler fume outlet;

36 first fume course access opening of the heat convection pipe bundle;
37 boiler air inlet;
38 heat convection pipe bundle;
39 heat convection pipe bundle refractory concrete partition;
40 primary combustion chamber profiled seat with a square top and a circular bottom;
41 primary combustion chamber square membrane water-cooled wall;
42 primary combustion chamber Venturi tube internal circulator;
43 secondary combustion chamber square membrane water-cooled wall;
44 secondary combustion chamber mechanical fluidizing machine wear-resistant high temperature concrete layer;
45 secondary combustion chamber profiled seat with a square top and a circular bottom;
46 primary combustion chamber mechanical fluidizing machine air distributing plate;
47 primary combustion chamber mechanical fluidizing machine oriented blast cap;
48 primary combustion chamber mechanical fluidizing machine electric motor;
49 primary combustion chamber mechanical fluidizing machine redactor;
50 primary combustion chamber mechanical fluidizing machine mount pin;
51 primary combustion chamber mechanical fluidizing machine reductor mount flange;
52 primary combustion chamber mechanical fluidizing machine wind protection fluidizing fin air inlet;
53 secondary combustion chamber mechanical fluidizing machine air distributing plate;
54 secondary combustion chamber mechanical fluidizing machine mount pin;
55 secondary combustion chamber mechanical fluidizing machine redactor;
56 secondary combustion chamber mechanical fluidizing machine electric motor;
57 secondary combustion chamber mechanical fluidizing machine reductor mount flange; and
58 secondary combustion chamber mechanical fluidizing machine wind protection fluidizing fin air inlet.

DETAILED DESCRIPTION OF THE EMBODIMENTS

Figure 2:
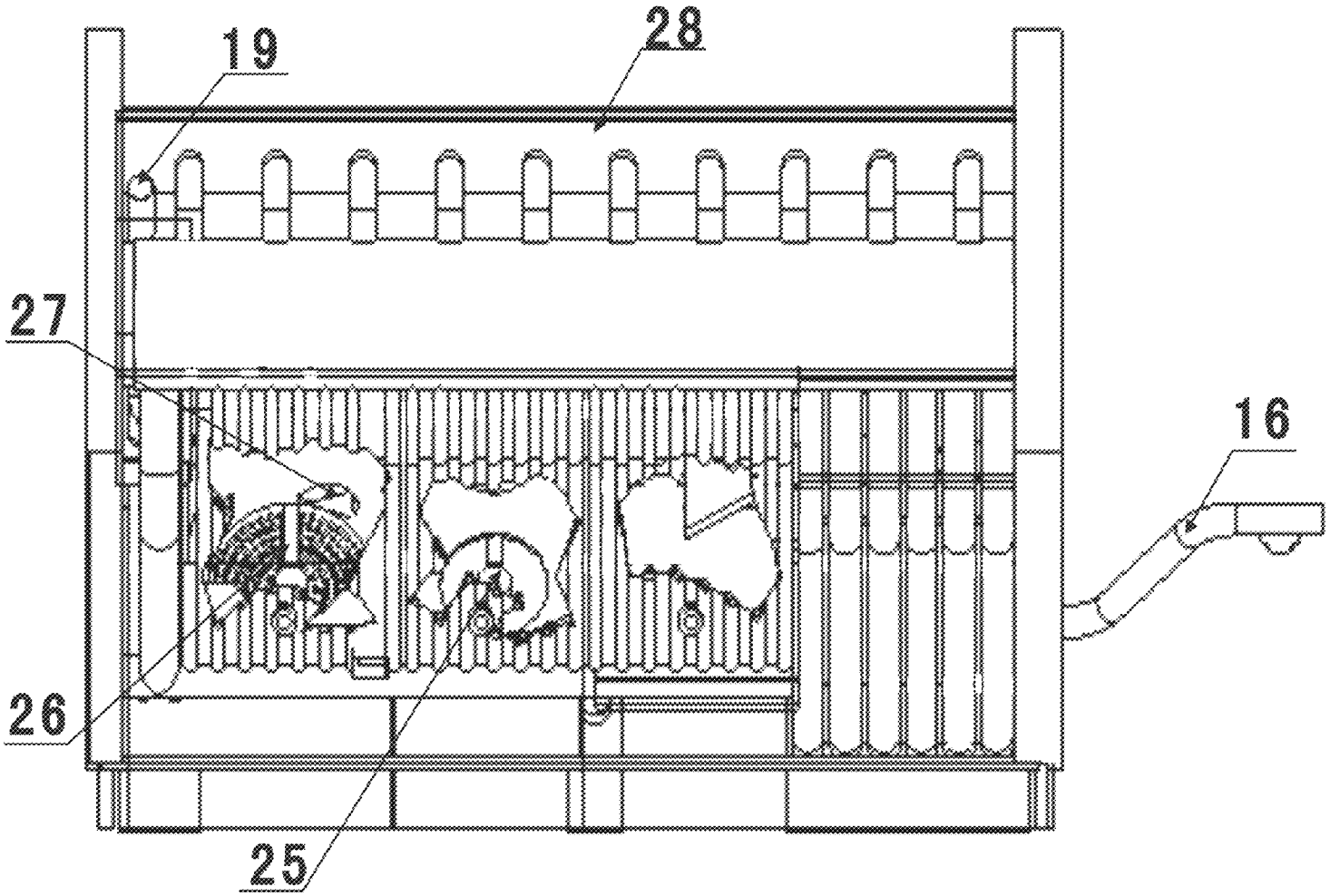
FIG. 2 is a right top view of the boiler of the present invention. This view is mainly to reveal the profiled seat with a square top and a circular bottom inside the combustion chamber and the mechanical fluidizing machine structure. To facilitate revealing the internal structure, the outer thermal insulation layer and the outer packaging case of the boiler are removed.
Figure 3:
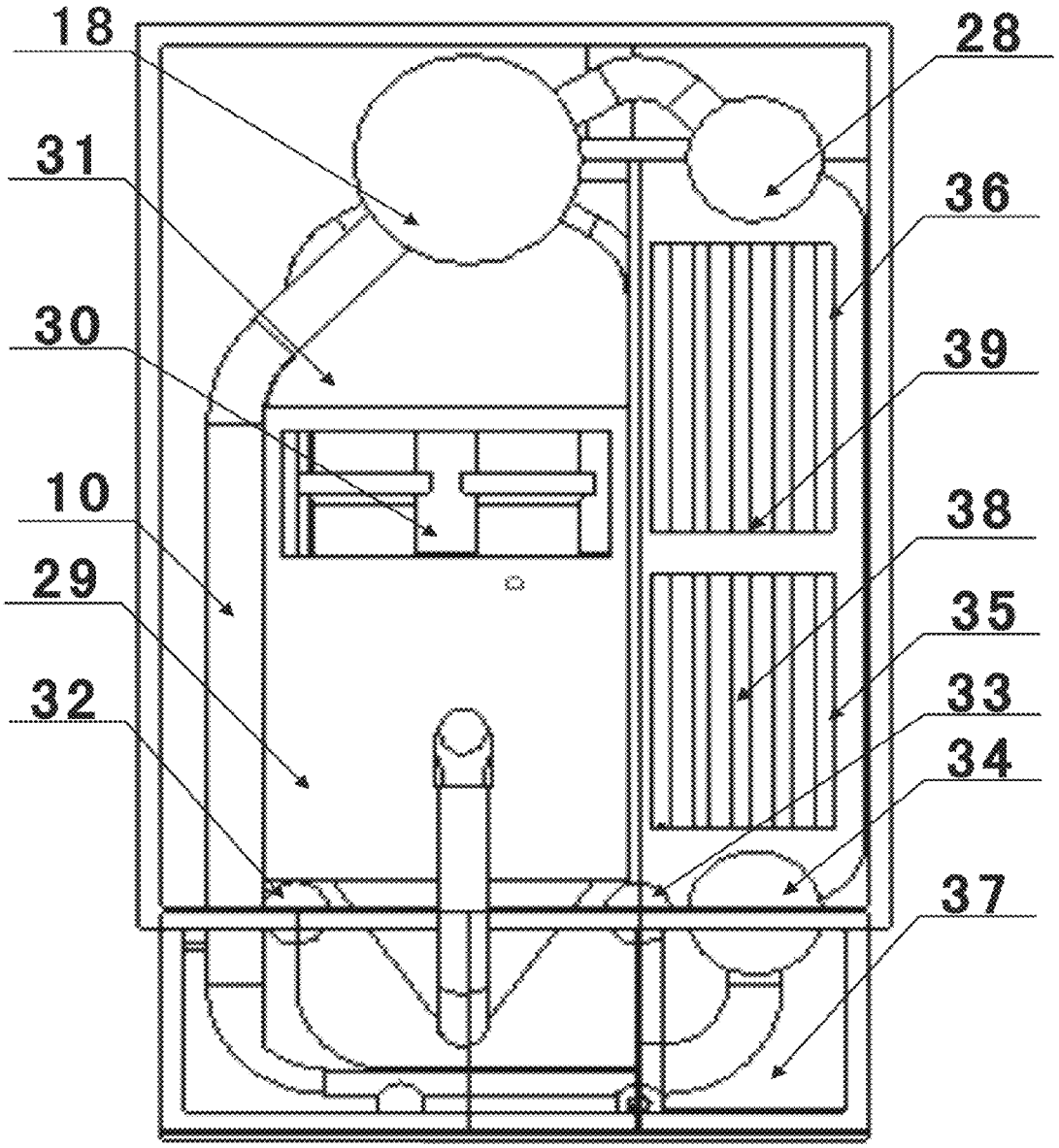
FIG. 3 is a rear view of the boiler of the present invention. To facilitate revealing the internal structure, the rear closing plate of the boiler, the access door, the fume outlet interface, the air inlet interface, the outer thermal insulation layer and the outer packaging case of the boiler are removed.
Figure 4:
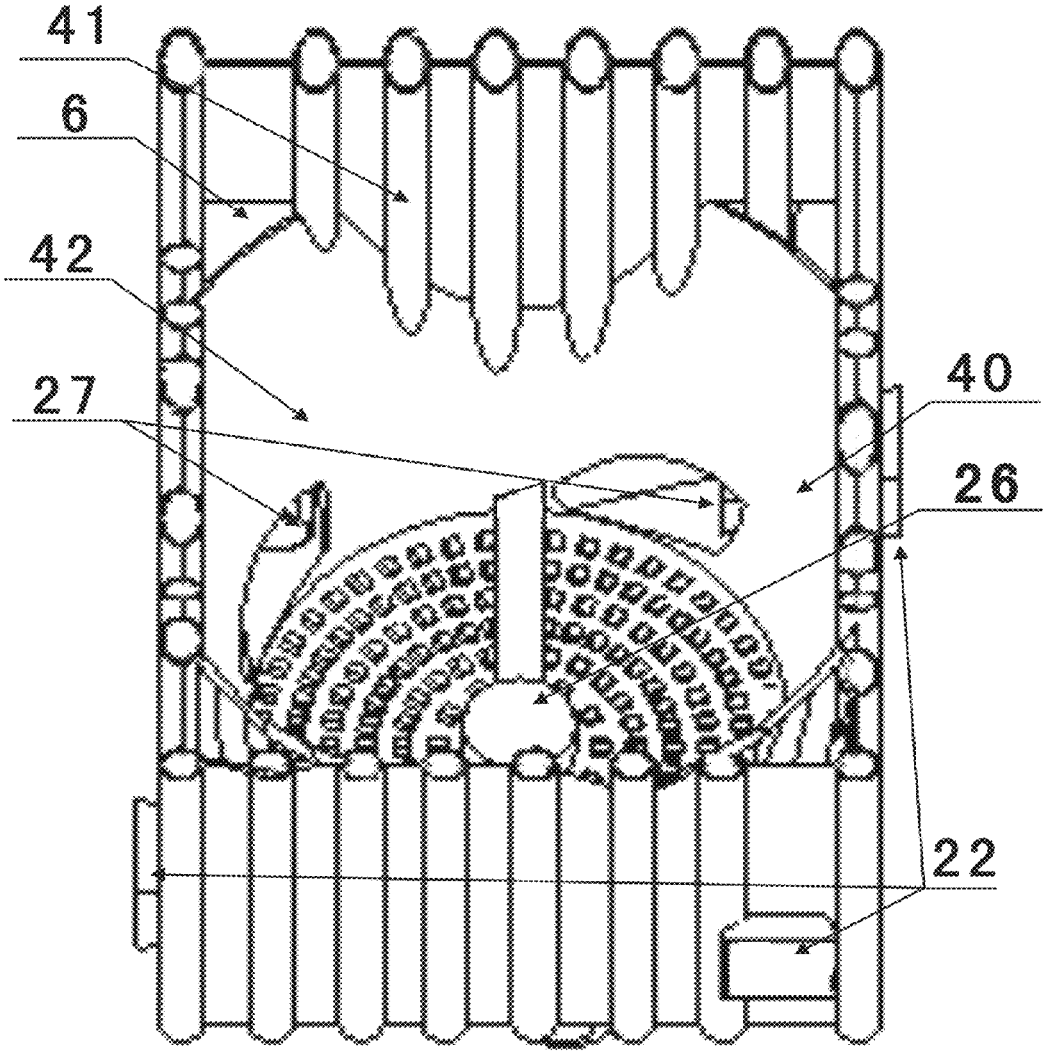
FIG. 4 is a right top sectional view of the primary combustion chamber of the boiler of the present invention.
Figure 5:
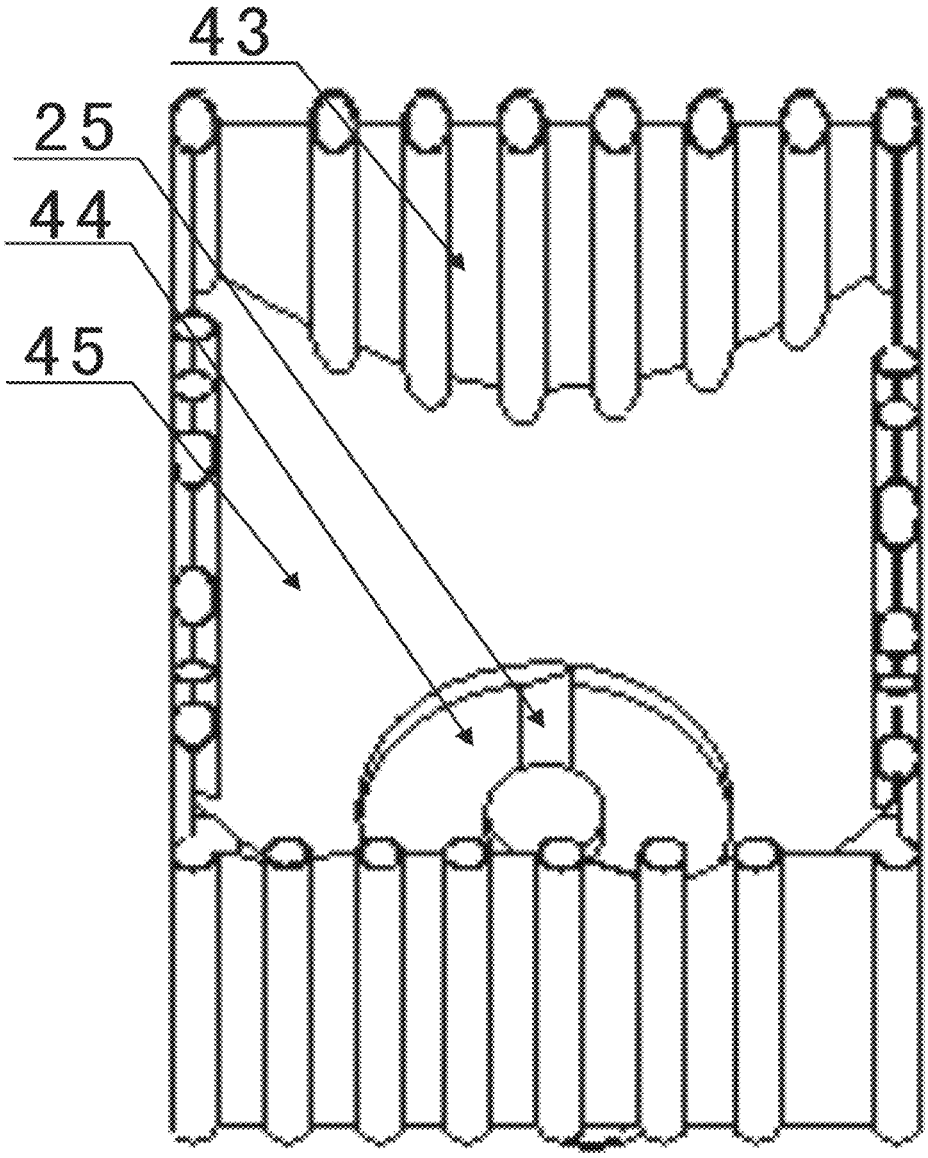
FIG. 5 is a right top sectional view of the secondary combustion chamber of the boiler of the present invention.
Figure 6:
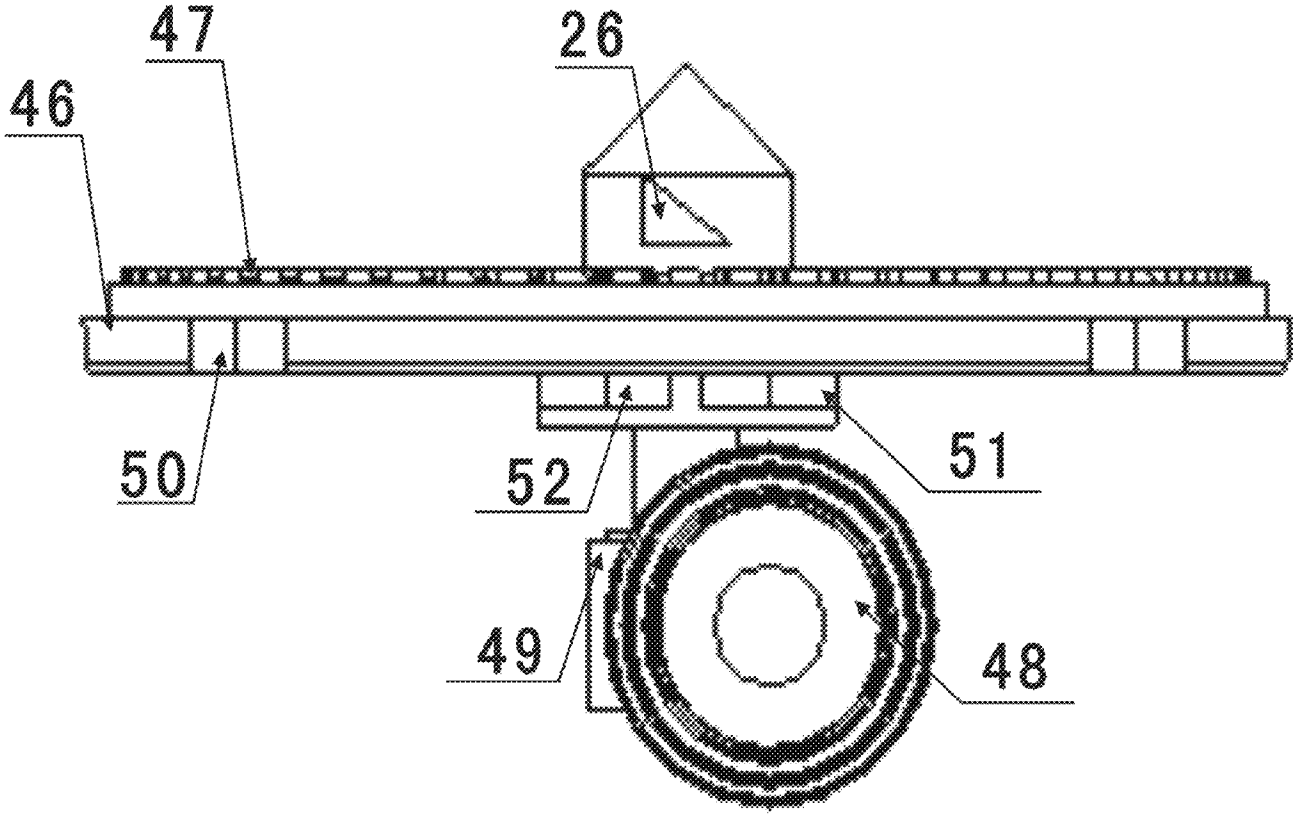
FIG. 6 is a right view of the primary combustion chamber mechanical fluidizing machine of the boiler of the present invention.
Figure 7:
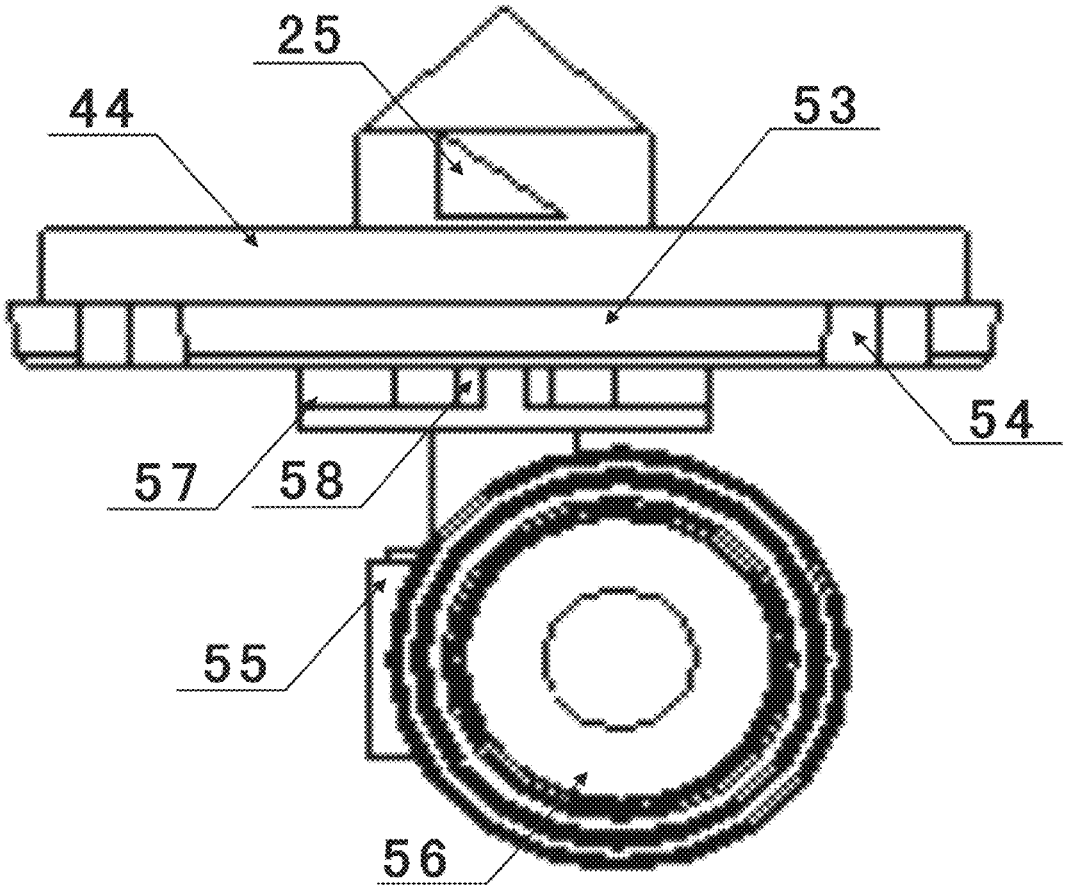
FIG. 7 is a right view of the secondary combustion chamber mechanical fluidizing machine of the boiler of the present invention.

With reference to FIGS. 1, 2, 3, 4, 5, 6, and 7, the present invention comprises a primary combustion chamber 1, a secondary combustion chamber 2, a burning-out chamber 3, a high temperature multi-tube cyclone dust collector 29, and a heat convection pipe bundle 38. The primary combustion chamber 1 consists of, from top to down, a primary combustion chamber fume outlet 20, a primary combustion chamber square membrane water-cooled wall 41, a primary combustion chamber profiled seat with a square top and a circular bottom 40, a primary combustion chamber Venturi tube internal circulator 42, and a primary combustion chamber mechanical fluidizing machine 4. The primary combustion chamber Venturi tube internal circulator 42 consists of a primary combustion chamber Venturi tube internal circulator trap hole 6, a primary combustion chamber Venturi tube internal circulator air inlet 22, and a primary combustion chamber Venturi tube internal circulator nozzle 27. The primary combustion chamber mechanical fluidizing machine 4 consists of a primary combustion chamber mechanical fluidizing machine air distributing plate 46, a primary combustion chamber mechanical fluidizing machine oriented blast cap 47, a primary combustion chamber mechanical fluidizing machine wind protection fluidizing fin 26, a primary combustion chamber mechanical fluidizing machine electric motor 48, a primary combustion chamber mechanical fluidizing machine reductor 49, a primary combustion chamber mechanical fluidizing machine mount pin 50, a primary combustion chamber mechanical fluidizing machine reductor mount flange 51, and a primary combustion chamber mechanical fluidizing machine wind protection fluidizing fin air inlet 52. The primary combustion chamber mechanical fluidizing machine 4 and the primary combustion chamber 1 are connected by the mount pin 50. The primary combustion chamber 1 and the secondary combustion chamber 2 are in direct communication by the primary combustion chamber fume outlet 20, and the primary combustion chamber fume outlet 20 is open in the upper portion of the membrane water-cooled wall which separates the primary combustion chamber 1 from the secondary combustion chamber 2. The secondary combustion chamber 2 consists of, from top to down, a secondary combustion chamber profiled fume-venting tube 21, a secondary combustion chamber square membrane water-cooled wall 43, a secondary combustion chamber profiled seat with a square top and a circular bottom 45, and a secondary combustion chamber mechanical fluidizing machine 5. The secondary combustion chamber profiled fume-venting tube 21 consists of a circular tube section, an elbow section and a tube section the shape of which changes from circular to square. The circular tube section is perpendicularly mounted at the central position of the upper portion of the secondary combustion chamber 2. The square tube opening is connected with the secondary combustion chamber square membrane water-cooled wall 43 which separates the secondary combustion chamber 2 from the burning-out chamber 3, and at the opening of the water-cooled wall, there is formed a secondary combustion chamber fume outlet. The secondary combustion chamber profiled seat with a square top and a circular bottom 45 is mounted at the lower portion of the secondary combustion chamber 2. The secondary combustion chamber mechanical fluidizing machine 5 is mounted at the bottom of the secondary combustion chamber profiled seat with a square top and a circular bottom 45, and is connected with the secondary combustion chamber profiled seat with a square top and a circular bottom 45 through the secondary combustion chamber mechanical fluidizing machine mount pin 54. The burning-out chamber 3 is enclosed by the burning-out chamber membrane water-cooled wall 23 and the burning-out chamber refractory concrete partition wall 24, the burning-out chamber refractory concrete baffle plate 8 is mounted at the middle portion of the burning-out chamber 3, and the burning-out chamber fume outlet 9 is mounted below the burning-out chamber refractory concrete baffle plate 8. The high temperature multi-tube cyclone dust collector 29 is mounted at the rear portion of the burning-out chamber 3, the high temperature multi-tube cyclone dust collector fume inlet 30 communicates with the burning-out chamber 3 via the burning-out chamber fume outlet 9, the high temperature multi-tube cyclone dust collector fume outlet 31 communicates with the heat convection pipe bundle 38, and the dust outlet of the high temperature multi-tube cyclone dust collector 29 is connected with the screw-type ash removal machine 16. The heat convection pipe bundle 38 is mounted at the left side of the boiler, and the heat convection pipe bundle refractory concrete partition 39 divides the heat convection pipe bundle 38 in the middle thereof into the upper portion and the lower portion. The upper portion is the first fume course, and the lower portion is the second fume course. The first fume course communicates with the high temperature multi-tube cyclone dust collector fume outlet 31, the second fume course communicates with the boiler fume outlet 35, and the first fume course communicates with the second fume course via the reversal chamber. The corner tube downtake 10 integrally connects the upper boiler drum 18, the left header 32, the right header 33, the upper header 28, and the lower header 34 so as to constitute the integral frame of the boiler.

The running process and the operating steps of the boiler are as follows. Firstly, the fuel which has been precisely metered and air-locked by the metering feed screw and the air-lock is conveyed into the primary combustion chamber 1 from the fuel bin via the fuel feed inlet 19. Meanwhile, the primary combustion chamber mechanical fluidizing machine 4 and the secondary combustion chamber mechanical fluidizing machine 5 are started. After a certain amount of fuel is fed, the metering feed screw is disabled, the blower and the draught fan are properly started, and the flame igniter is started to perform ignition. The flame igniter may adopt the fuel igniter, the gas igniter or the electric igniter. When the fuel in the primary combustion chamber 1 substantially enters the carbon burning state, the igniter is turned off, the blower and the draught fan are adjusted to operate in a greater degree, the metering feed screw is enabled, and the ignition is finished. The whole process of ignition lasts about 5-8 minutes.

After ignition, the metering feed screw is adjusted according to the demand of load to determine the feed amount of the fuel, and according to the feed amount of the fuel, the blower and the draught fan are adjusted to determine the correct intake amount of air. At this time, the boiler enters the running state. The fuel fed via the fuel feed inlet 19 quickly pyrolyzes and burns under the action of the high temperature environment of the primary combustion chamber 1. The fuel exhibits fast rotary combustion under the collective action of the primary combustion chamber mechanical fluidizing machine wind protection fluidizing fin 26, the primary combustion chamber mechanical fluidizing machine oriented blast cap 47, and the primary combustion chamber Venturi tube internal circulator nozzle 27. The primary air is provided by the primary combustion chamber mechanical fluidizing machine oriented blast cap 47, the primary combustion chamber mechanical fluidizing machine wind protection fluidizing fin 26 and the primary combustion chamber Venturi tube internal circulator nozzle 27. The primary combustion chamber mechanical fluidizing machine wind protection fluidizing fin 26 may quickly break the ash shell of the burning fuel, so as to increase the combustion rate and prevent the slag formation through the bonding of the ash shell. The large carbon granules after the pyrolysis combustion of the fuel under the action of the cyclone are thrown to the four corners of the fire wall, and are trapped by the trap hole 6 of the Venturi tube internal circulator so as to return to the bottom of the combustion chamber and continue the combustion. The small carbon granules and the hot fume after the combustion of the primary large carbon granules are discharged into the secondary combustion chamber 2 via the fume outlet 20 of the primary combustion chamber and continue the combustion. The primary combustion chamber 1 mainly carries out the process of the pyrolysis of the biomass fuel and the combustion of the large carbon granules, and the reasonably arranged radiation heat-absorbing surface of the membrane water-cooled wall may ensure that the combustion temperature of the primary combustion chamber 1 is about 900° C. As a result, the emission of the NOx is greatly reduced, and it is effectively ensured that no slag formation occurs in the combustion process.

After the hot fume which enters the secondary combustion chamber 2 from the fume outlet 20 of the primary combustion chamber is separated by the secondary combustion chamber profiled separator, the small carbon granules deposit on the bottom and the fluidization combustion continues. The secondary air is provided by the secondary combustion chamber mechanical fluidizing machine wind protection fluidizing fin 25, the mechanical fluidization on the fuel by the secondary combustion chamber mechanical fluidizing machine wind protection fluidizing fin 25 may cause the secondary air and the fuel to sufficiently mix up so as to improve the combustion intensity and effectively prevent the slag formation through the bonding of the ash shell. The reasonably arranged radiation heat-absorbing surface of the membrane water-cooled wall and the refractory concrete thermal insulation layer may ensure that the combustion temperature of the secondary combustion chamber 2 is about 800° C. The hot fume after the secondary combustion and a small amount of micro-carbon granules are discharged into the burning-out chamber 3 via the secondary combustion chamber profiled fume-venting tube 21.

The hot fume containing fine carbon granules which enters the burning-out chamber 3 from the secondary combustion chamber 2 subjects to the final tertiary burning-out combustion in the burning-out chamber. The perturbation of the refractory concrete baffle plate 8 on the fume increases the contact of air with the fuel and also increases the tertiary combustion rate. The hot fume after the burning-out is dedusted by the high temperature multi-tube cyclone dust collector 29 and exchanges heat by the heat convection pipe bundle 38, and then it is discharged from the boiler through the fume outlet 35 of the boiler. The smoke and dust separated by the high temperature multi-tube cyclone dust collector 29 is discharged out via the screw-type ash removal machine 16.

The shutting-down of the boiler is performed merely by stopping the metering feed screw feed the fuel to the primary combustion chamber 1. After about 2-3 minutes, there will be no naked flame in the primary combustion chamber 1. By keeping the blower and the draught fan running for a certain period so as to make the temperature of the primary combustion chamber 1 drop to below the combustion temperature, the boiler then may be entirely shut down.

In the boiler of the present invention, the corner tube downtake 10 connects the various headers integrally to form the framework of the boiler, and the circulation loop may be adjusted according to the various applications so as to make the boiler satisfy the requirements of the steam boiler, the hot-water boiler, the vacuum boiler or the thermal medium boiler.

All of the above operations may be programmed to be carried out automatically by a program.

The invention claimed is:

1. A biomass fuel internal circulation mechanical fluidized-bed corner tube intelligent boiler, comprising a primary combustion chamber, a secondary combustion chamber, a burning-out chamber, a mechanical fluidizing machine, a Venturi tube internal circulator, a high temperature multi-tube cyclone dust collector, a heat convection pipe bundle, characterized in that, in the primary combustion chamber, a profiled hearth is defined by a square omniseal membrane water-cooled wall and a profiled seat with a square top and a circular bottom, at the four corners of the profiled seat with the square top and the circular bottom, there are mounted Venturi tube internal circulators, at bottom of the profiled hearth, there is provided a mechanical fluidizing machine, behind top portion of the hearth, there is provided a fume outlet which directly communicates with the secondary combustion chamber, and a running of the boiler is carried out automatically by a program.

2. The biomass fuel internal circulation mechanical fluidized-bed corner tube intelligent boiler according to claim 1, characterized in that:

the mechanical fluidizing machine consists of an air distributing plate, an electric motor, a reductor, a reductor mount flange, a wind protection fluidizing fin, and a wind protection fluidizing fin air inlet, and on the air distributing plate, there is mounted an oriented blast cap or coated refractory wear-resistant concrete.

3. The biomass fuel internal circulation mechanical fluidized-bed corner tube intelligent boiler according to claim 1, characterized in that:

the Venturi tube internal circulator consists of a profiled seat with a square top and a circular bottom, a Venturi tube internal circulator trap hole, an air inlet, and a nozzle, and the Venturi tube internal circulator adopts a clockwise-four-corner arrangement.

4. The biomass fuel internal circulation mechanical fluidized-bed corner tube intelligent boiler according to claim 1, characterized in that:

at rear portion of the primary combustion chamber, there is provided the secondary combustion chamber, which consists of a square omniseal membrane water-cooled wall and a profiled seat with a square top and a circular bottom, bottom portion of the secondary combustion chamber is provided with a mechanical fluidizing machine, upper portion of the secondary combustion chamber is provided with a profiled fume-venting tube, the profiled fume-venting tube consists of a circular tube section, an elbow section and a tube section, shape of which changes from circular to square, the circular tube section is perpendicularly mounted at the center of the upper portion of the secondary combustion chamber, opening of the square tube section is connected with the rear membrane water-cooled wall of the secondary combustion chamber, and the membrane water-cooled wall is provided with an opening in such a manner that the secondary combustion chamber communicates with the burning-out chamber via the profiled fume-venting tube.

* * * * *